US009791824B2

(12) United States Patent
Yamamoto

(10) Patent No.: US 9,791,824 B2
(45) Date of Patent: Oct. 17, 2017

(54) IMAGE FORMING APPARATUS

(71) Applicant: KYOCERA Document Solutions Inc., Osaka (JP)

(72) Inventor: Kiyonori Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 27 days.

(21) Appl. No.: 15/177,647

(22) Filed: Jun. 9, 2016

(65) Prior Publication Data

US 2016/0363906 A1 Dec. 15, 2016

(30) Foreign Application Priority Data

Jun. 15, 2015 (JP) ..... 2015-120325

(51) Int. Cl.
*G03G 21/16* (2006.01)

(52) U.S. Cl.
CPC ..... *G03G 21/1661* (2013.01)

(58) Field of Classification Search
CPC ..... G03G 21/1619; G03G 21/1661; G03G 21/1842; G03G 21/1846; G03G 2221/1684
See application file for complete search history.

(56) References Cited

U.S. PATENT DOCUMENTS 8,229,319 B2 * 7/2012 Tomatsu ..... G03G 21/1853 399/110
8,682,212 B2 * 3/2014 Kikuchi ..... G03G 21/1853 399/110
9,367,015 B2 * 6/2016 Doyo ..... G03G 15/6502

FOREIGN PATENT DOCUMENTS

JP 2004-299214 A 10/2004

* cited by examiner

*Primary Examiner* — Gregory H Curran
(74) *Attorney, Agent, or Firm* — Studebaker & Brackett PC

(57) ABSTRACT

An image forming apparatus includes a housing and a pair of cassette guides. The housing is provided with a cassette storage space and a unit storage space. The unit storage space is disposed above the cassette storage space and configured to slidably support an image forming unit. The housing has a pair of side plates arranged to be opposite to each other in a direction intersecting a sliding direction of the image forming unit. The pair of cassette guides is provided in the cassette storage space and arranged inside the pair of side plate. A guide rail part is formed by a gap between the side plate and the guide cassette arranged inside the side plate, and a top face of the cassette guide. A unit-side rail provided to the image forming unit is slidably engaged with the guide rail part.

8 Claims, 16 Drawing Sheets

IMAGE FORMING APPARATUS

INCORPORATION BY REFERENCE

This application is based on and claims the benefit of priority from Japanese Patent application No. 2015-120325 filed on Jun. 15, 2015, the entire contents of which are incorporated herein by reference.

BACKGROUND

The present disclosure relates to an image forming apparatus which includes a slide-type image forming unit.

An image forming apparatus, such as a printer, a copying machine and a multifunctional peripheral, is sometimes provided with an attachable/detachable unit, such as an image forming unit and a sheet feeding cassette. In some cases, such an attachable/detachable unit is configured to slide with respect to an apparatus main body and to be held in a drawn state from the apparatus main body to some extent.

An image forming apparatus provided with such a slide-type attachable/detachable unit generally employs a configuration where the unit to be attached and detached is provided with a fixed rail and an extended rail which engages with the fixed rail and the apparatus main body is provided with a rail guide which guides the extended rail.

However, the image forming apparatus employing such a configuration needs a space for providing the rail guide in the apparatus main body, and therefore there is a problem that the apparatus main body becomes larger and the number of members and the number of working processes increase.

SUMMARY

In accordance with an embodiment of the present disclosure, an image forming apparatus includes a housing and a pair of cassette guides. The housing is provided with a cassette storage space and a unit storage space. The cassette storage space is configured to store a sheet feeing cassette. The unit storage space is disposed above the cassette storage space and configured to slidably support an image forming unit. The housing has a pair of side plates arranged to be opposite to each other in a direction intersecting a sliding direction of the image forming unit. The pair of cassette guides is provided in the cassette storage space and arranged inside the pair of side plate. The guide rail part is formed by a gap between each of the pair of side plates and each of the pair of guide cassettes arranged inside the pair of side plates, and a top face of each of the pair of cassette guides. A unit-side rail is provided to the image forming unit is slidably engaged with the guide rail part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to one embodiment of the present disclosure will be described.

Figure 1:
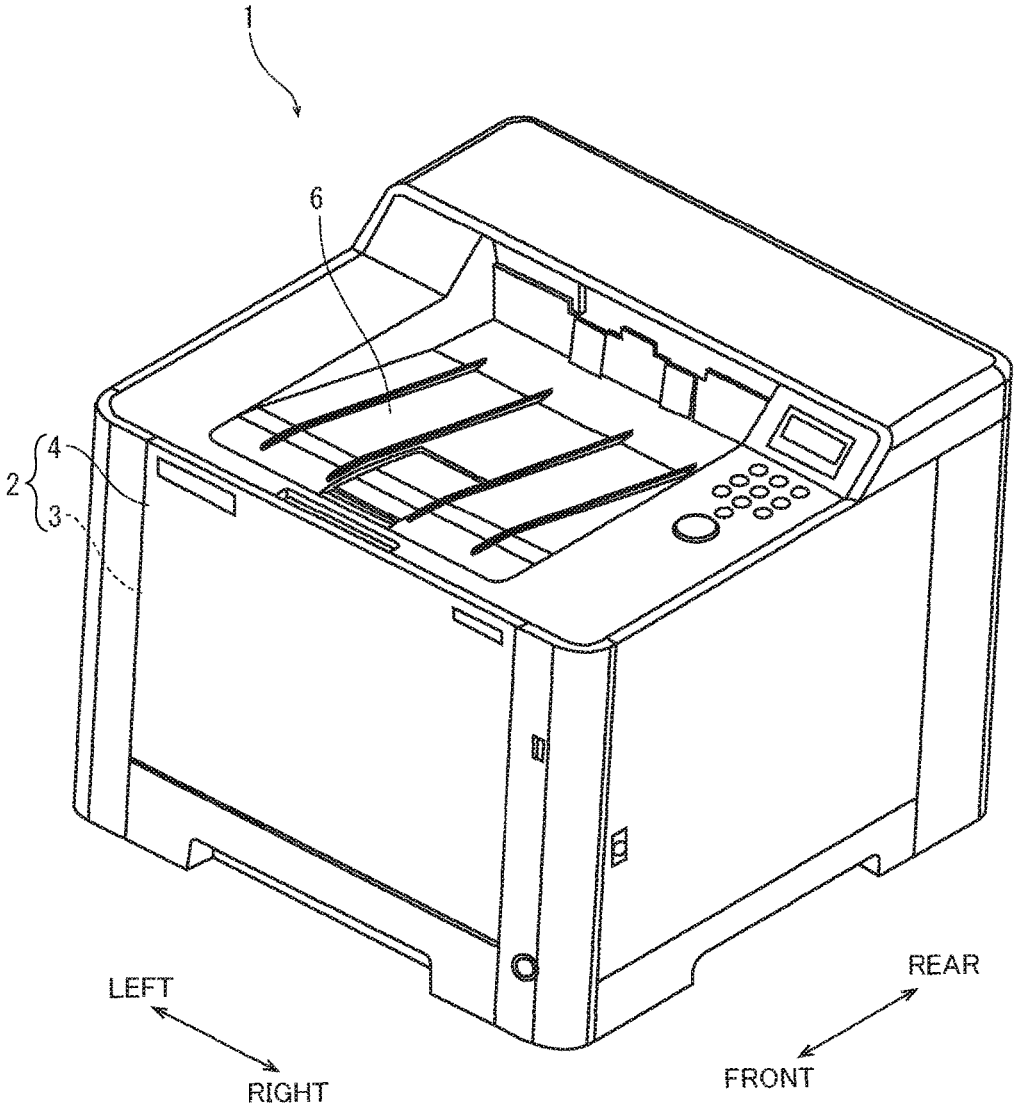
FIG. 1 is a perspective view showing an external appearance of a color printer according to one embodiment of the present disclosure.
Figure 2:
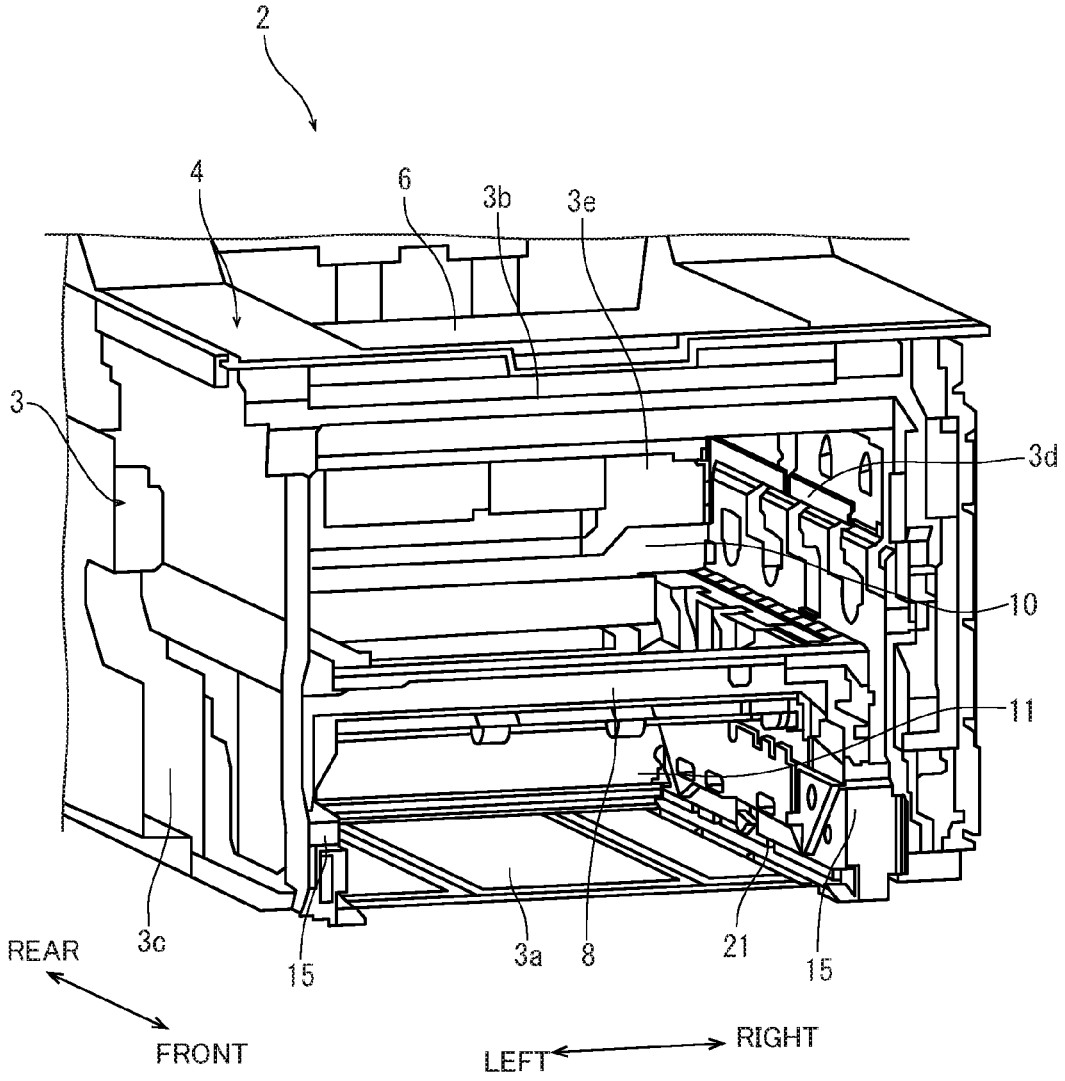
FIG. 2 is a perspective view showing an apparatus main body of the color printer according to one embodiment of the present disclosure.
Figure 3:
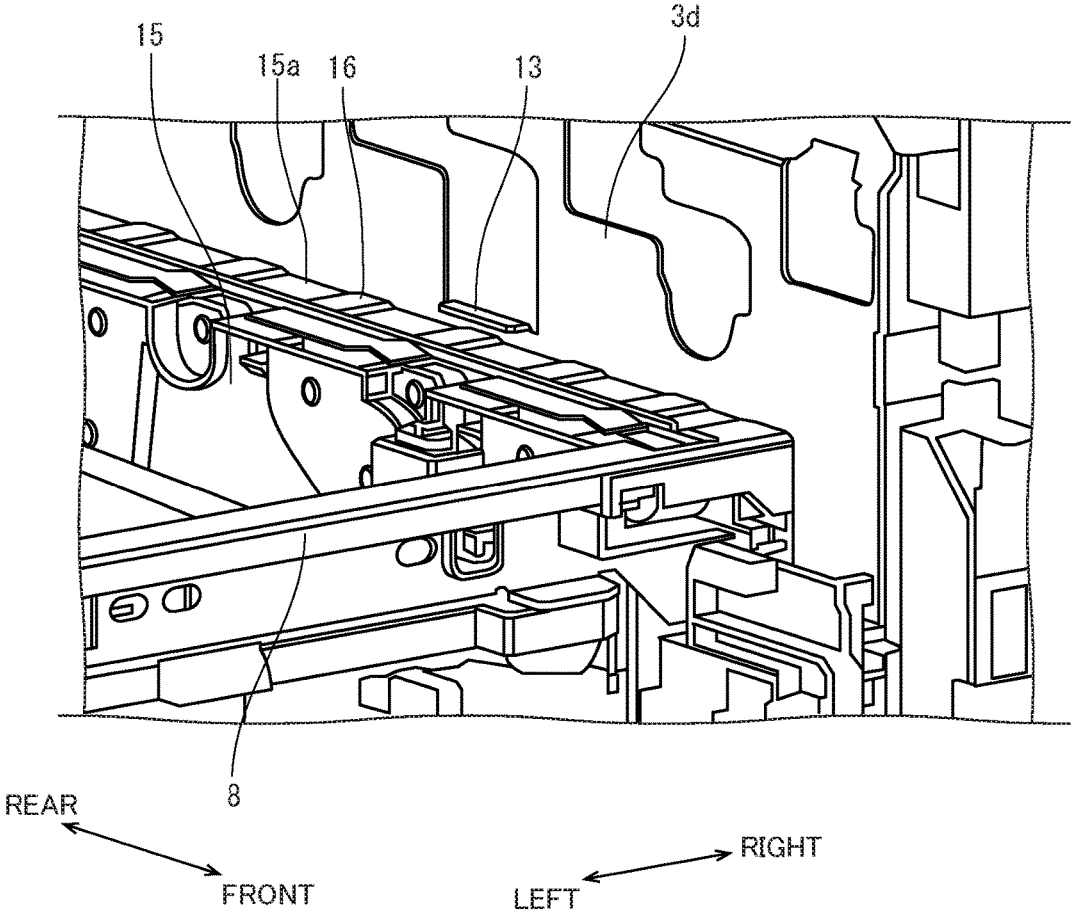
FIG. 3 is a perspective view showing a guide rail part of the color printer according to one embodiment of the present disclosure.
Figure 4:
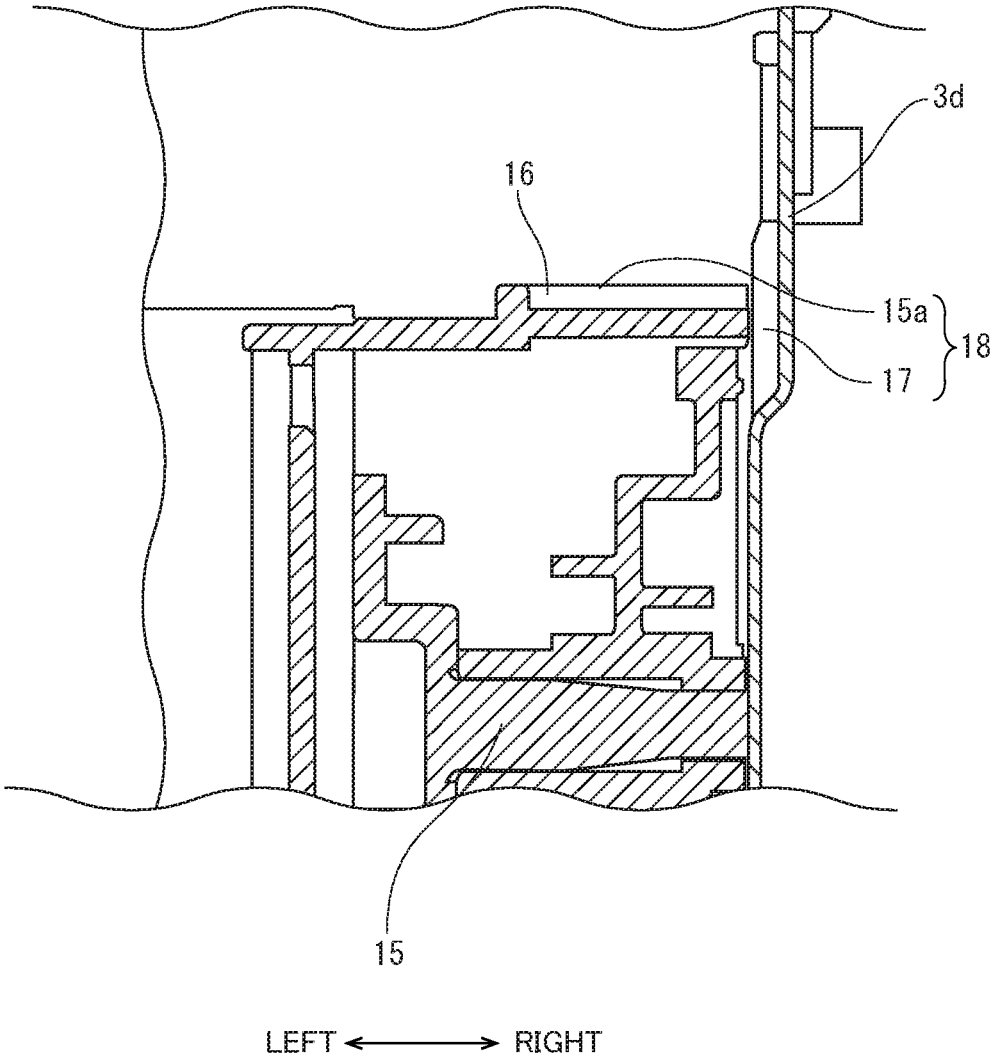
FIG. 4 is a front view showing the guide rail part of the color printer according to one embodiment of the present disclosure.
Figure 5:
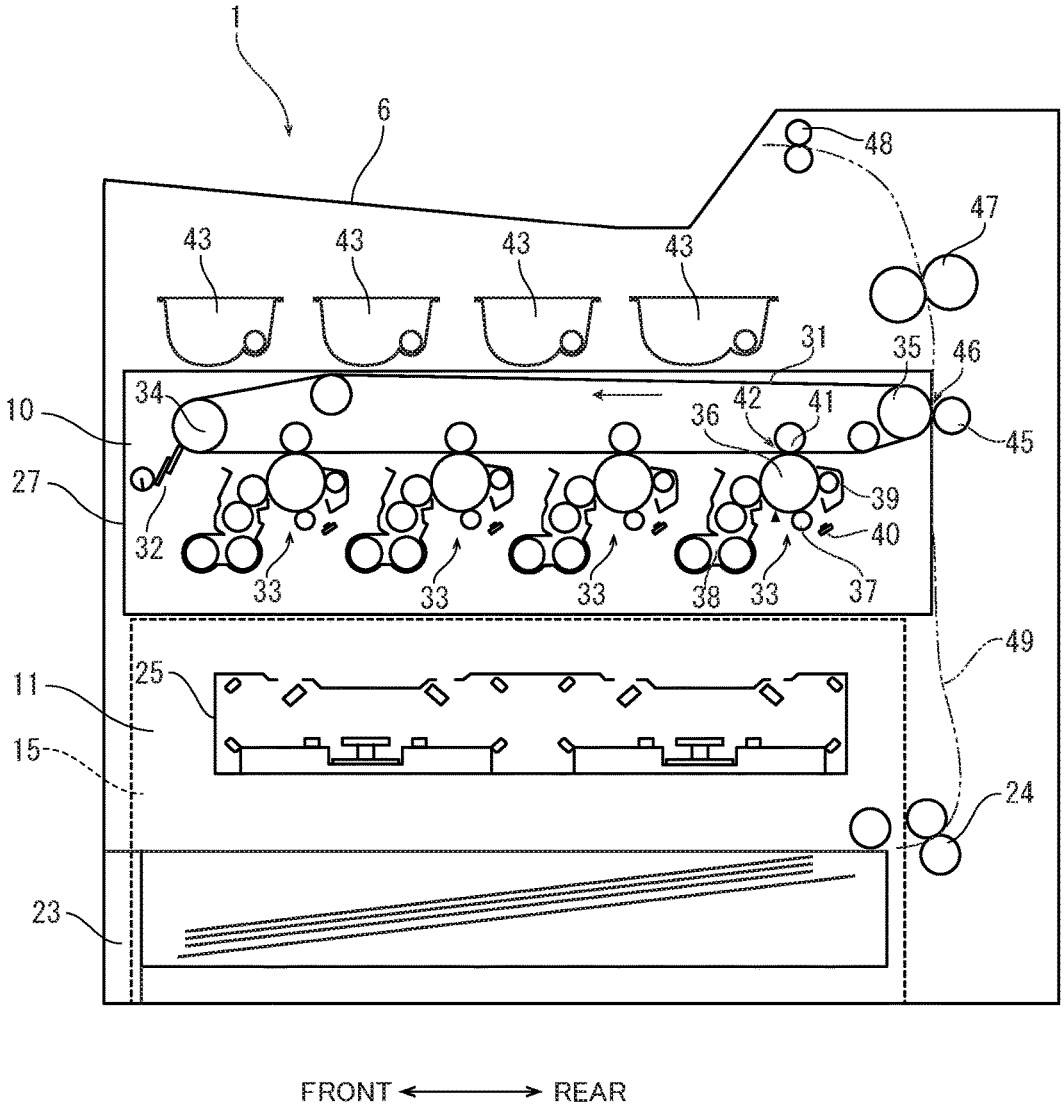
FIG. 5 is a view schematically showing an internal structure of the color printer according to one embodiment of the present disclosure.
Figure 6:
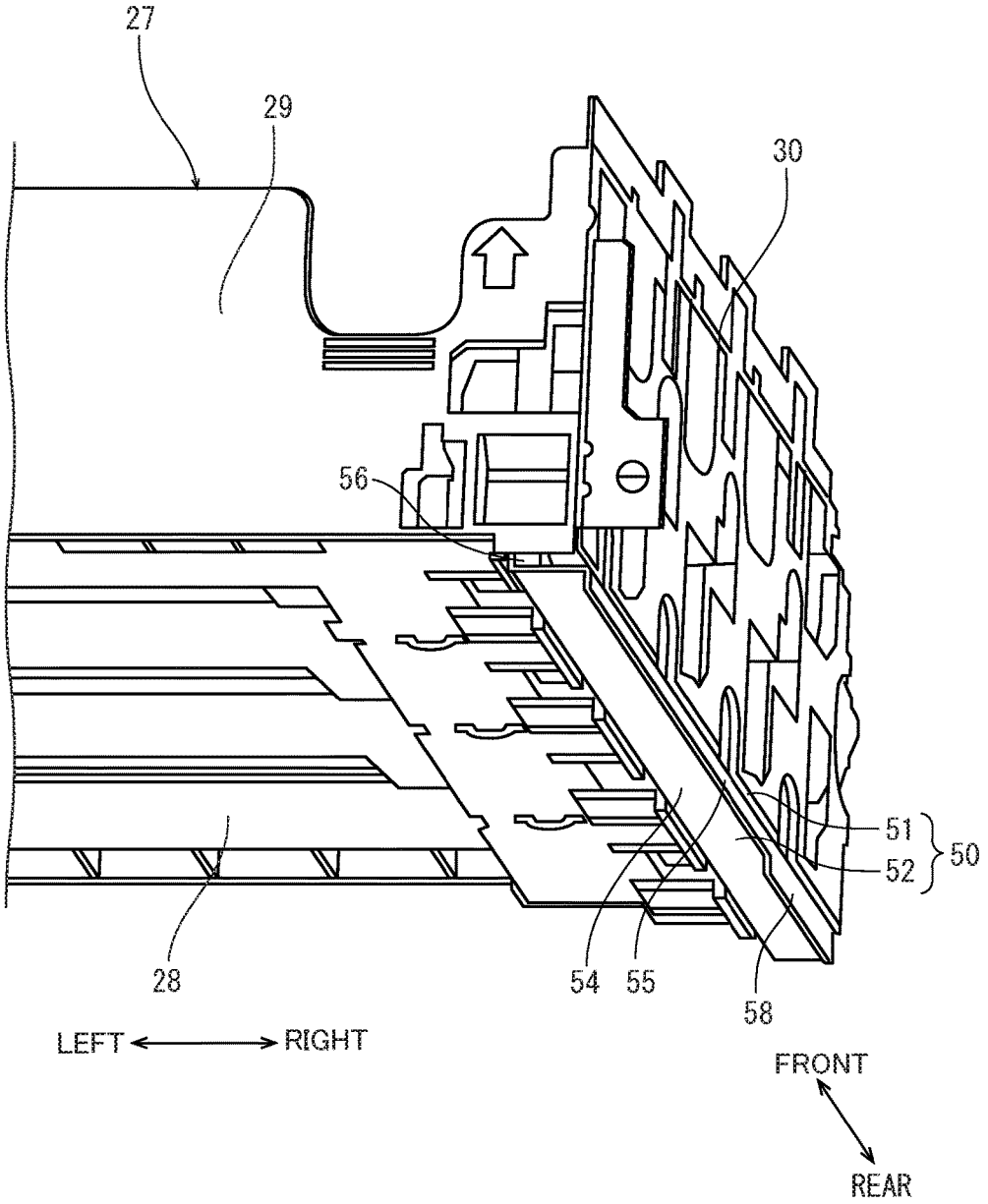
FIG. 6 is a perspective view showing an image forming unit of the color printer according to one embodiment of the present disclosure.

First, with reference to FIG. 1 to FIG. 5, an entire structure of a color printer 1 (image forming apparatus) according to the embodiment of the present disclosure will be described. FIG. 1 is a perspective view showing an external appearance of the color printer, FIG. 2 is a perspective view showing an apparatus main body, FIG. 3 is a perspective view showing a guide rail part of the apparatus main body, FIG. 4 is a front view showing the guide rail part, FIG. 5 is a view schematically showing an internal structure of the color printer and FIG. 6 is a perspective view showing an image forming unit. In the following description, front and rear directions and left and right directions are based on front and rear directions and left and right directions indicated in FIG. 1.

The color printer 1 has a rectangular parallelepiped shaped apparatus main body 2 as shown in FIG. 1. The apparatus main body 2 has a housing 3 which forms a frame of the color printer 1 and an exterior cover 4 which covers an outside of the housing 3. The housing 3 is formed by a bottom plate 3*a*, a top plate 3*b*, a left side plate 3*c*, a right side plate 3*d* and a rear plate 3*e* as shown in FIG. 2. The left side plate 3*c* and the right side plate 3*d* are opposite to each other in the left and right directions. A front face of the housing 3 is opened. On an upper face of the exterior cover 4 which covers the outside of the top plate 3*b*, an ejected sheet tray 6 on which a sheet is ejected is formed.

Across the front opening of the housing 3, a stay 8 is bridged between the left side plate 3*c* and the right side plate 3*d* near a center in the vertical direction. The inside of the housing 3 is divided into a unit storage space 10 above the stay 8 and a cassette storage space 11 under the stay 8. As shown in FIG. 3, in the unit storage space 10, the left side plate 3*c* and the right side plate 3*d* are formed with holding pieces 13 protruding inward along the front and rear directions. The holding piece 13 of the right side plate 3*d* is formed by forming a protruding piece along a lower edge of an opening and then bending the protruding piece inward.

The cassette storage space 11 is provided with a pair of left and right cassette guides 15, as shown in FIG. 2. The pair of left and right cassette guides 15 each having a vertically long rectangular parallelepiped shape are arranged along the inside faces of the left side plate 3*c* and the right side plate 3*d* of the housing 3, respectively. The cassette guide 15 is made of a resin material. As shown in FIG. 3, an upper face 15*a* of the cassette guide 15 is formed into a flat plane. On the upper face 15*a*, a plurality of protruded parts 16 each having a flat upper plane are formed at a predetermined intervals in the front and rear directions. As shown in FIG. 4, the left and right side plates 3*c* and 3*d* are configured such that a gap 17 of a predetermined width is formed between each left and right side plates 3*c* and 3*d* and an upper portion of the cassette guide 15 arranged inward of each left and right side plates 3*c* and 3*d*. The gap 17 and the upper face 15*a* of the cassette guide 15 forms a guide rail part 18.

As shown in FIG. 2, on a lower portion of an inside face of each cassette guide 15, a groove 21 is formed along the front and rear directions. With the grooves 21, rails formed in a sheet feeding cassette 23 (refer to FIG. 5) are engaged so that the sheet feeding cassette 23 is slidably supported to the cassette storage space 11.

As shown in FIG. 5, in a rear space of the cassette storage space 11, a sheet feeding device 24 configured to feed the sheet stored in the sheet feeding cassette 23 is provided. In an upper space of the cassette storage space 11, an exposure device 25 containing a laser scanning unit (LSU) is provided.

In the unit storage space 10, an image forming unit 27 is attachably and detachably supported. As shown in FIG. 6, the image forming unit 27 has a bottom plate 28, a front plate 29 and left and right supporting plates 30 which are opposite to each other in the left and right directions. The image forming unit 27 is provided with an intermediate transferring belt 31, a belt cleaning device 32 and four image forming parts 33. The intermediate transferring belt 31 is supported between the left and right supporting plates 30 so as to be rotated along the front and rear directions around a driving roller 34 and a driven roller 35 which are arranged at predetermined intervals in the front and rear directions. The belt cleaning device 32 is arranged facing the driving roller 34 through the intermediate transferring belt 31. Four image forming parts 33 are arranged under the intermediate transferring belt 31 along the front and rear directions.

Each of the image forming parts 33 is provided with a photosensitive drum 36 supported rotatably. Around the photosensitive drum 36, a charger 37, a development device 38, a cleaning device 39 and a static eliminator 40 are arranged in the order of a first transferring process. Between the development device 38 and the cleaning device 39, a first transferring roller 41 is arranged so as to form a first transferring part 42 between the photosensitive drum 36 and the intermediate transferring belt 31. Above the image forming unit 27, four toner containers 43 each containing toner of different color (magenta, cyan, yellow and black) are provided so as to connect to the corresponding image forming parts 33.

In a rear space of the unit storage space 10, a second transferring roller 45 is arranged facing the intermediate transferring belt 31 to form a second transferring part 46 between the intermediate transferring belt 31 and the second transferring roller 45. Above the second transferring part 46, a fixing device 47 is provided. Above the fixing device 47, a sheet ejecting part 48 is provided. Inside of the housing 3, a sheet conveying path 49 is provided so as to extend from the sheet feeding part 24 to the sheet ejecting part 48 through the second transferring part 46 and the fixing device 47.

Next, the operation of forming an image by the color printer 1 having such a configuration will be described. After a surface of the photosensitive drum 36 is charged by the charger 37, the exposure device 25 exposes the surface of the photosensitive drum 36 with a laser light to form an electrostatic latent image on the surface of the photosensitive drum 36. The electrostatic latent image is then developed into a toner image of corresponding color by the developing device 38. The toner image is first-transferred on the intermediate transferring belt 31 at the first transferring part 42. The above-mentioned operation is repeated in order by the image forming parts 33, thereby forming a full color toner image onto the intermediate transferring belt 31. Incidentally, toner and residual electric charge remained on the photosensitive drum 36 are removed by the cleaning device 39 and the static eliminator 40, respectively.

On the other hand, the sheet fed from the sheet feeding cassette 23 by the sheet feeding device 24 is conveyed to the second transferring part 46 in a suitable timing for the above-mentioned image forming operation. Then, in the second transferring part 46, the full color toner image on the intermediate transferring belt 31 is second-transferred onto the sheet. The sheet with the second-transferred toner image is conveyed to a downstream side along the sheet conveying path 49 to enter the fixing device 47 and then, the toner image is fixed on the sheet in the fixing device 47. The sheet with the fixed toner image is ejected from the sheet ejecting device 48 onto the ejected sheet tray 6. The toner remained on the intermediate transferring belt 31 is removed by the belt cleaning device 32.

Figure 7:
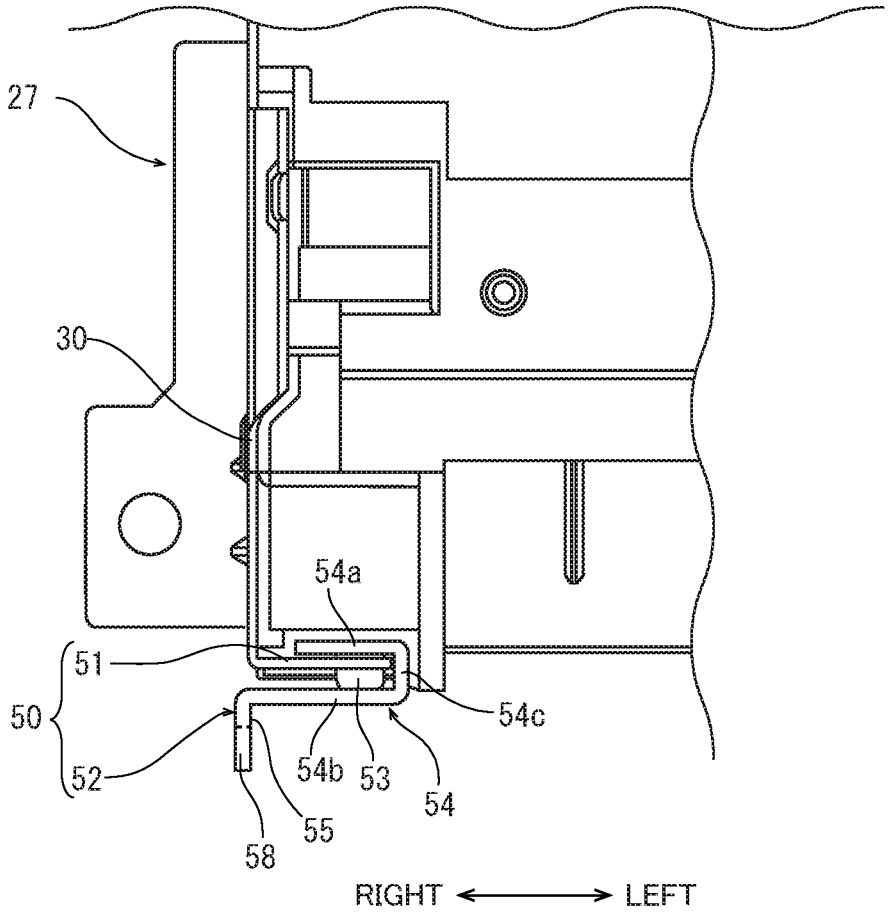
FIG. 7 is a view showing a unit-side rail of the image forming unit viewed from a rear side, in the color printer according to one embodiment of the present disclosure.
Figure 9:
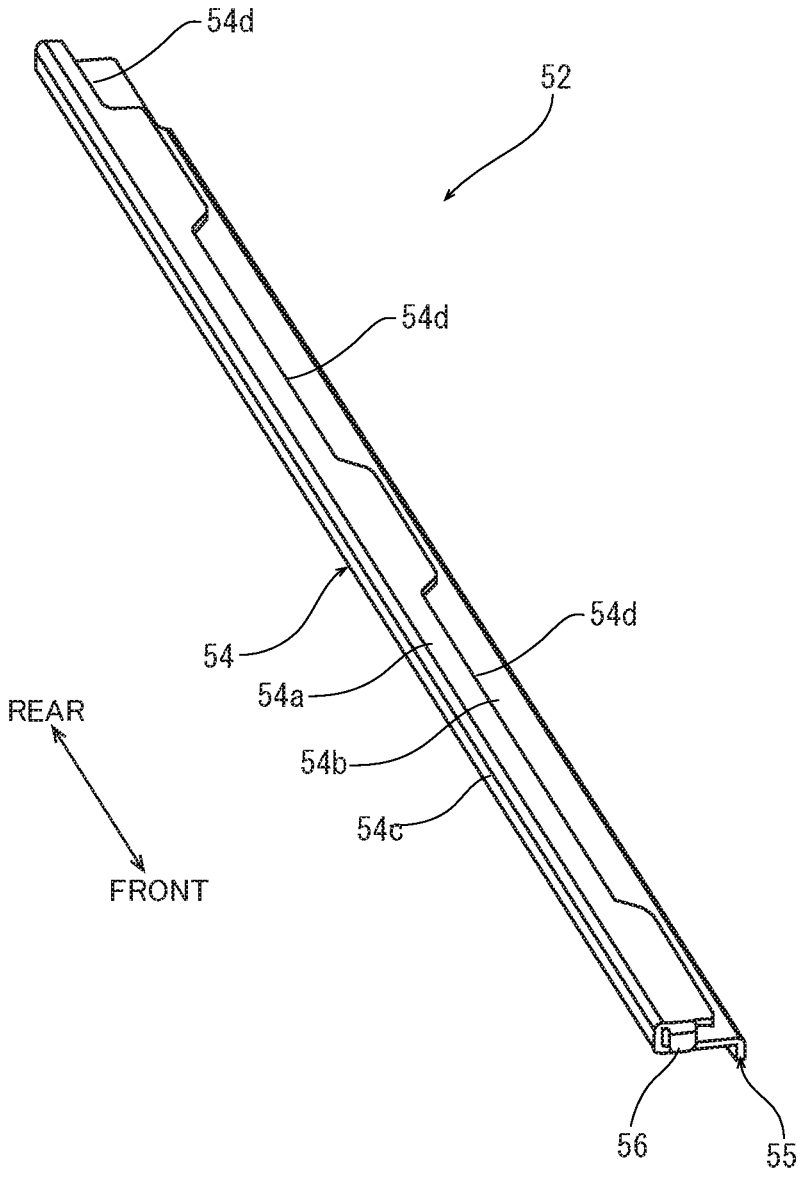
FIG. 9 is a perspective view showing a movable rail of the unit-side rail viewed from an above side, in the color printer according to one embodiment of the present disclosure.
Figure 10:
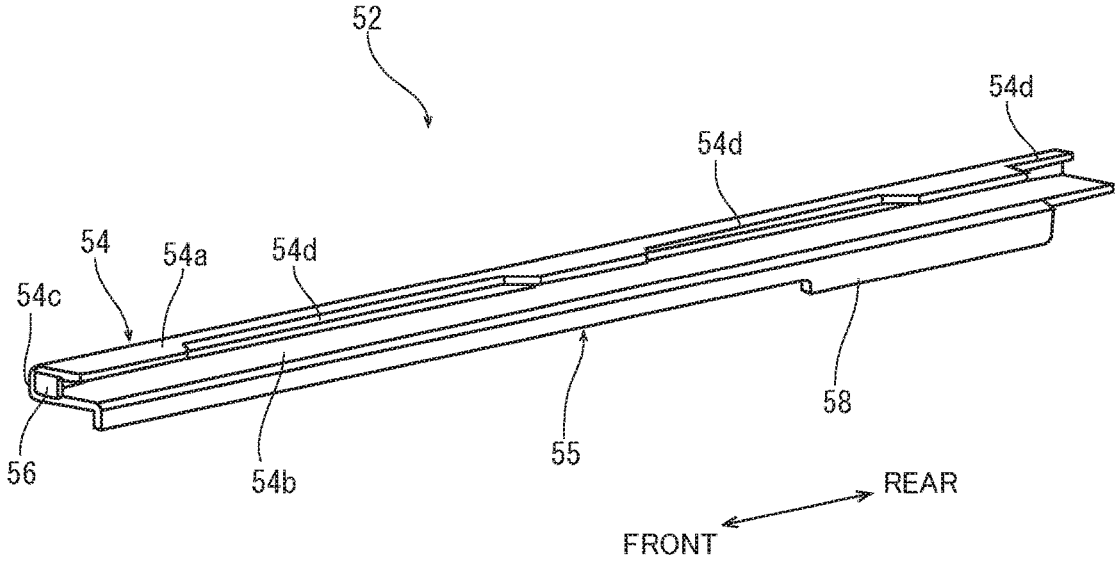
FIG. 10 is a perspective view showing the movable rail of the unit-side rail viewed from a right side, in the color printer according to one embodiment of the present disclosure.
Figure 11:
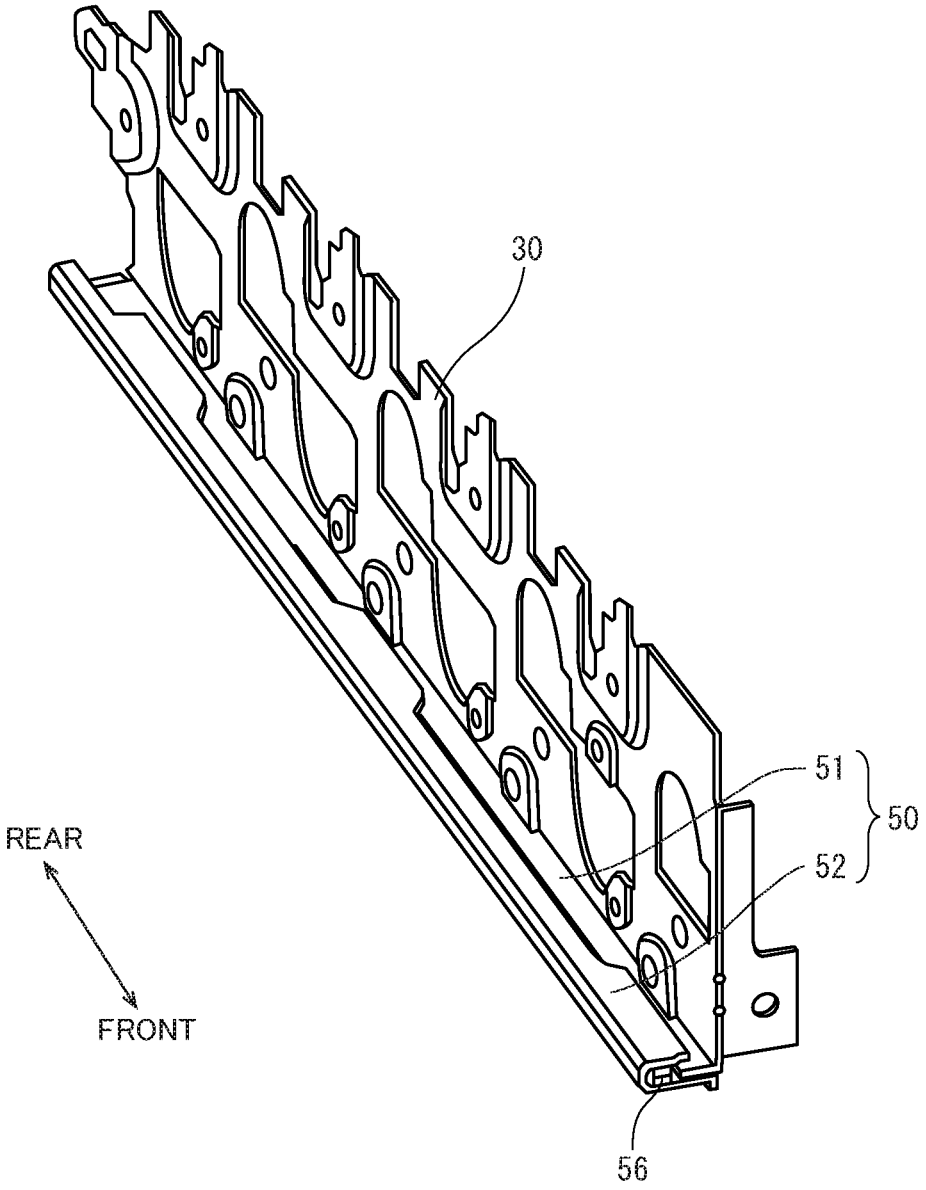
FIG. 11 is a perspective view showing an engagement state of the rail piece with the movable rail before the rail piece is drawn with respect to the movable rail, in the color printer according to one embodiment of the present disclosure.
Figure 12:
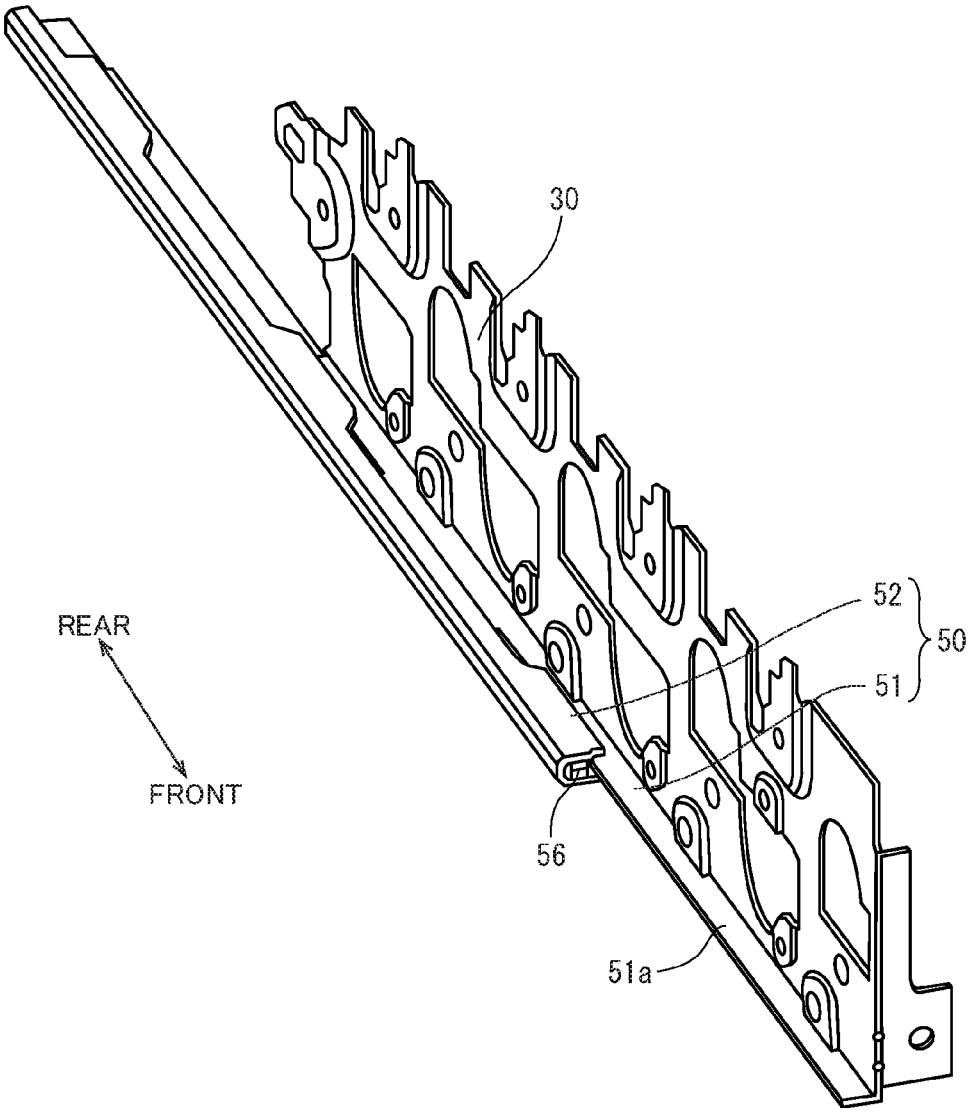
FIG. 12 is a perspective view showing the engagement state of the rail piece with the movable rail when the rail piece is drawn with respect to the movable rail, in the color printer according to one embodiment of the present disclosure.
Figure 13A:
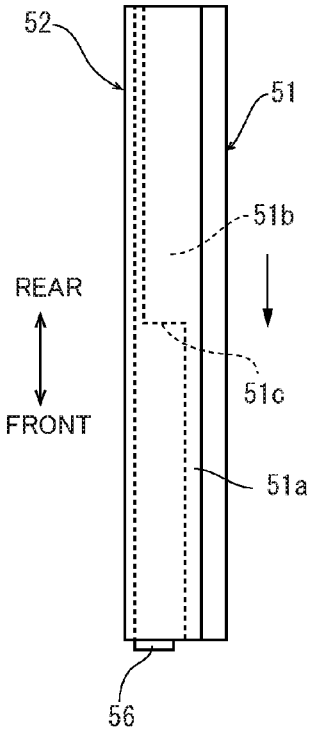
FIG. 13A is a plan view schematically showing a positional relationship between the rail piece and the movable rail in a state where the image forming unit is stored, in the color printer according to one embodiment of the present disclosure.
Figure 13B:
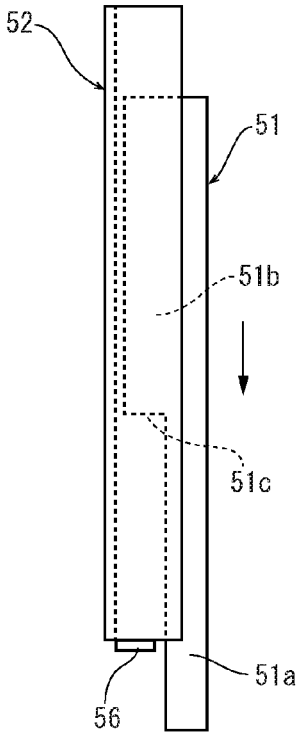
FIG. 13B is a plan view schematically showing the positional relationship between the rail piece and the movable rail in a state where the image forming unit is drawn halfway, in the color printer according to one embodiment of the present disclosure.
Figure 13C:
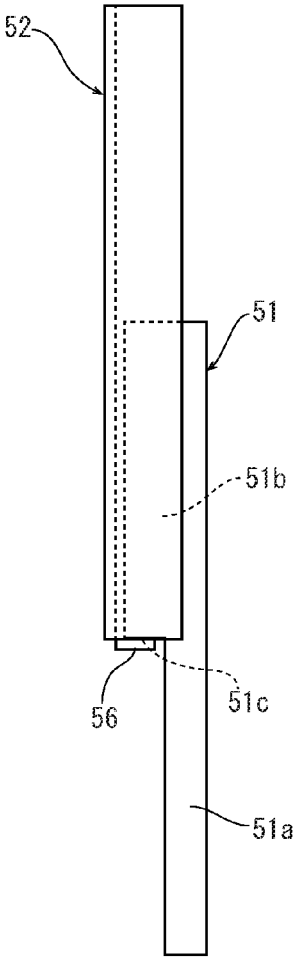
FIG. 13C is a plan view schematically showing the positional relationship between the rail piece and the movable rail in a state where the imaging unit is drawn out into a first drawing step, in the color printer according to one embodiment of the present disclosure.

Next, the image forming unit 27 will be described with reference to FIGS. 7 to 14. FIG. 7 is a view showing a unit-side rail viewed from a rear side, FIG. 8 is a perspective view showing a rail piece, FIGS. 9 and 10 are perspective views showing a movable rail, FIGS. 11 and 12 are perspective views showing the rail piece and the movable rail which are engaged each other, and FIGS. 13A, 13B and 13C are plan views schematically showing a positional relationship between the rail piece and the movable rail during the image forming unit is drawn out.

As shown in FIG. 7, a unit-side rail 50 is formed along a lower edge of each of the left and right supporting plates 30 of the image forming unit 27. The unit-side rail 50 has a rail piece 51 and a movable rail 52. The rail piece 51 is formed by bending a lower end portion of each of the left and right supporting plates 30 inward at a nearly right angle. The movable rail 52 is engaged with the rail piece 51.

Figure 8:
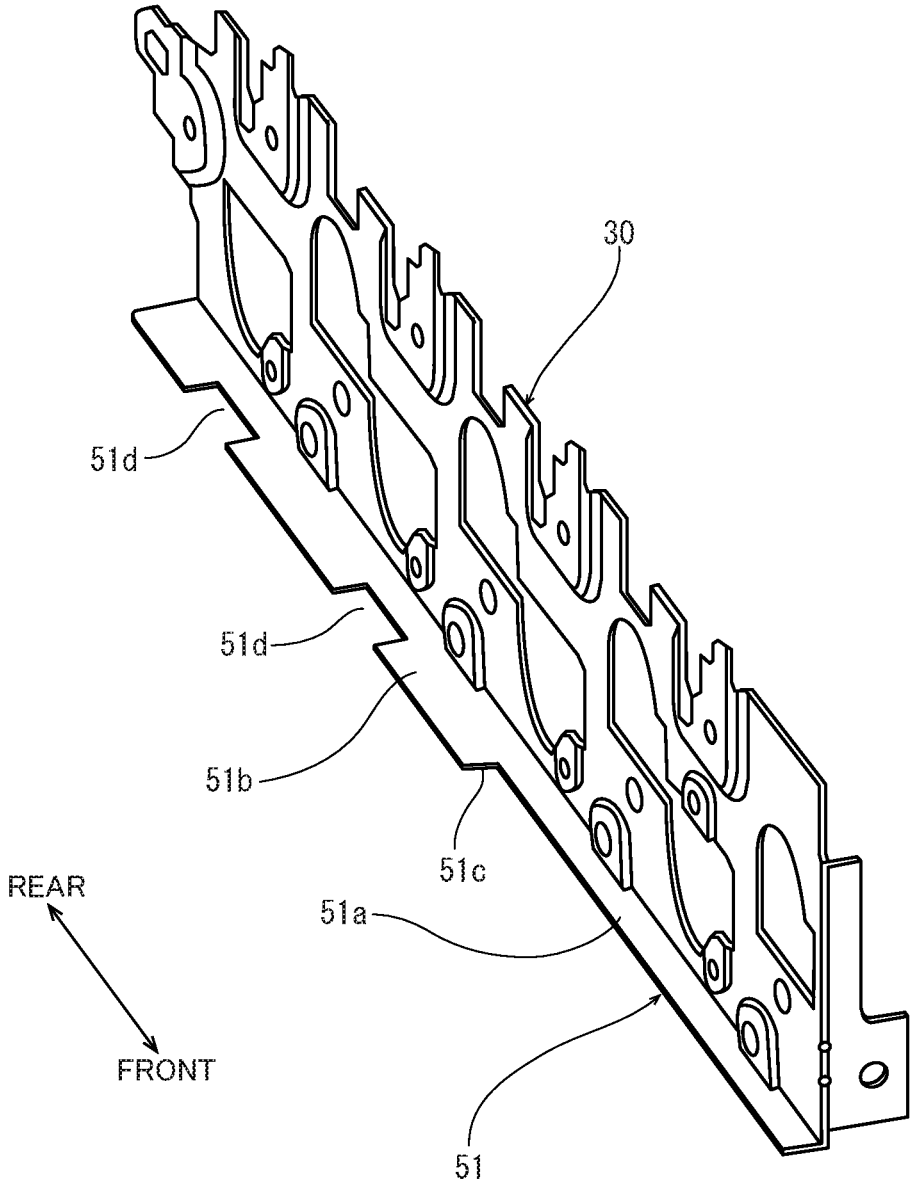
FIG. 8 is a perspective view showing a rail piece of the unit-side rail, in the color printer according to one embodiment of the present disclosure.

The rail piece 51 includes a front half part 51*a* of a narrower width and a rear half part 51*b* of a wider width as shown in FIG. 8. Between the front half part 51*a* and the rear half part 51*b*, a step part 51*c* is formed. Further, along an inner edge of the rear half part 51*b*, two of rectangular shaped cutaways 51*d* are formed. On a lower face of the rail piece 51, as shown in FIG. 7, a plurality of semispherical projections 53 are formed at predetermined intervals.

The movable rail 52 has approximately the same length as the length of the rail piece 51 in the front and rear directions. The movable rail 52 includes an engagement part 54 and an engagement piece 55. The engagement part 54 has a U-shaped sectional shape whose outer side face is opened. The engagement piece 55 hangs downward from the engagement part 54. As shown in FIGS. 9 and 10, the engagement part 54 is formed by an upper plate 54*a*, a lower plate 54*b* and a vertical plate 54*c*. The upper plate 54*a* and the lower plate 54*b* are opposite to each other in the vertical direction. The upper plate 54*a* has a width narrower than the width of the rail piece 51. Along an outer edge of the upper plate 54*a*, three cutaways 54*d* are formed at predetermined intervals. Further, at a front edge of the upper plate 54*a*, a stoppage piece 56 bent downward is formed. The lower plate 54*b* has the same width as the width of the rail piece 51.

The engagement piece 55 is formed by being bent downward at a nearly right angle from an outer edge of the lower plate 54*b* of the engagement part 54. Along a rear end portion of the engagement piece 55, as shown in FIG. 10, a locking piece 58 protruding downward is formed. The length of the locking piece 58 is approximately ⅓ of the length of the engagement piece 55.

The image forming unit 27 can slide with respect to the unit-side rails 50 from a state (storage state) in which the entire of the rail piece 51 engages with the movable rail 52, as shown in FIG. 11, to a state (first drawing step) in which nearly a front half of the rail piece 51 is drawn forward from the movable rail 52, as shown in FIG. 12.

In the storage state, as shown in FIG. 13A, nearly an entire of the rail piece 51 engages with the engagement part 54 of the movable rail 52. When the image forming unit 27 is drawn forward, as shown in FIG. 13B, the front half part 51*a* of the rail piece 51 passes through a front opening of the engagement part 54, and then the rail piece 51 is guided along the movable rail 52. In this regard, since a top of each semispherical projections 53 of the rail piece 51 slides with respect to the lower plate 54*b* of the engagement part 54, it is possible to relatively reduce a friction between the rail piece 51 and the lower plate 54*b*. Then, as shown in FIG. 13C, when the image forming unit 27 is drawn into the first drawing step in which the step part 51*c* formed between the front half part 51*a* and the rear half part 51*b* of the rail piece 51 comes into contact with the stoppage piece 56 of the movable rail 52, the drawing of the image forming unit 27 is restricted.

Thus, nearly a front half of the image forming unit 27 can slide forward with respect to the movable rail 52.

Figure 14:
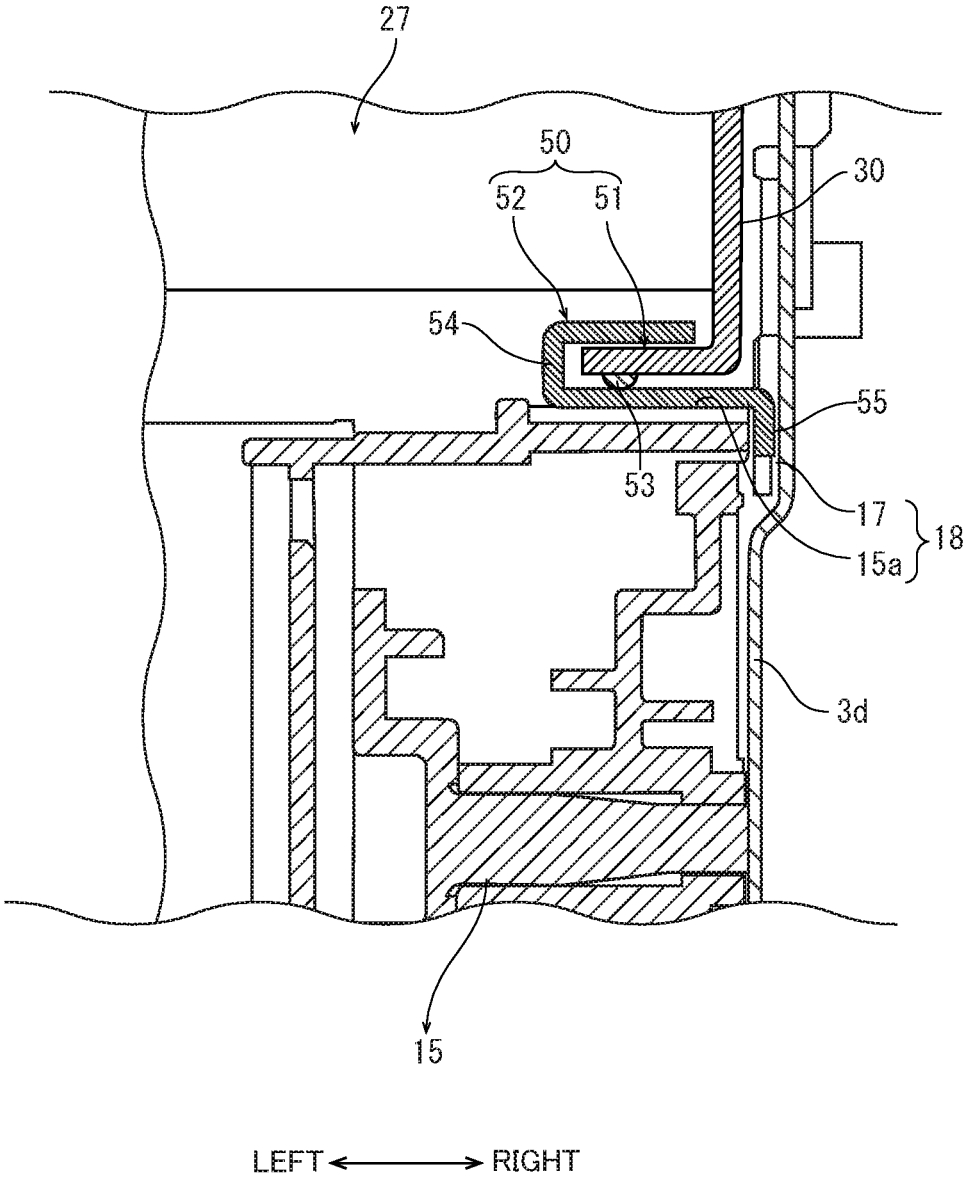
FIG. 14 is a front view showing the unit-side rail with which the guide rail part is engaged, in the color printer according to one embodiment of the present disclosure.

Next, an engagement of the unit-side rail 50 with the guide rail part 18 will be described with reference to FIG. 14. FIG. 14 is a front view showing a state where the unit-side rail engages with the guide rail part.

The image forming unit 27 is supported by the unit storage space 10 by engaging the movable rail 52 of the unit-side rail 50 with the guide rail part 18 of the housing 3. In more detail, the engagement part 54 of the movable rail 52 is supported on the top face 15*a* of each cassette guides 15, and the engagement piece 55 of the movable rail 52 is inserted in the gap 17 between each of the left and right side plates 3*c* and 3*d* of the housing 3 and each of the left and right cassette guides 15. Since the engagement part 54 is prevented from being displaced upward by the holding piece 13 (see FIG. 3) formed in each of the left and right side plates 3*c* and 3*d* of the housing 3, the engagement part 54 can slide in a horizontal direction along the top face 15*a* of the cassette guide 15. Further, since the engagement piece 55 passes through the gap 17 between each of the left and right side plates 3*c* and 3*d* and each of the left and right cassette guides 15, the image forming unit 27 is prevented from being displaced in the left and right directions so that the image forming unit 27 can stably slide in the front and rear directions on a horizontal plane.

Figure 15A:
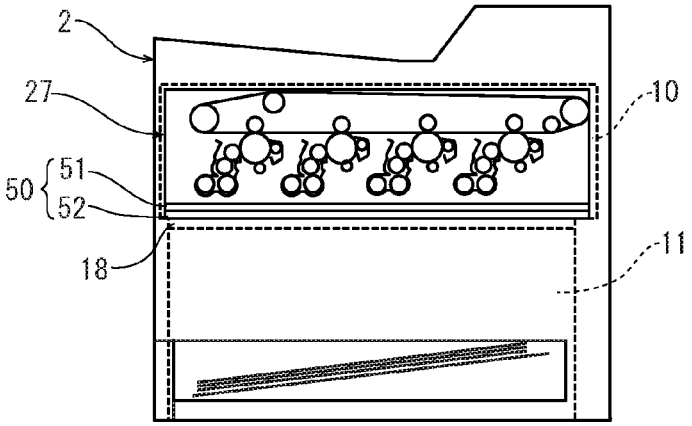
FIG. 15A is a side view showing the image forming unit at a storage state, in the color printer according to one embodiment of the present disclosure.
Figure 15B:
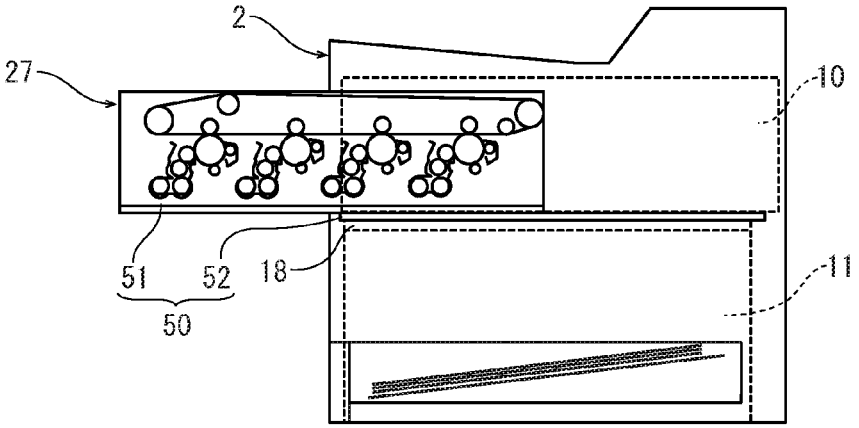
FIG. 15B is a side view showing the image forming unit at the first drawing step, in the color printer according to one embodiment of the present disclosure.
Figure 15C:
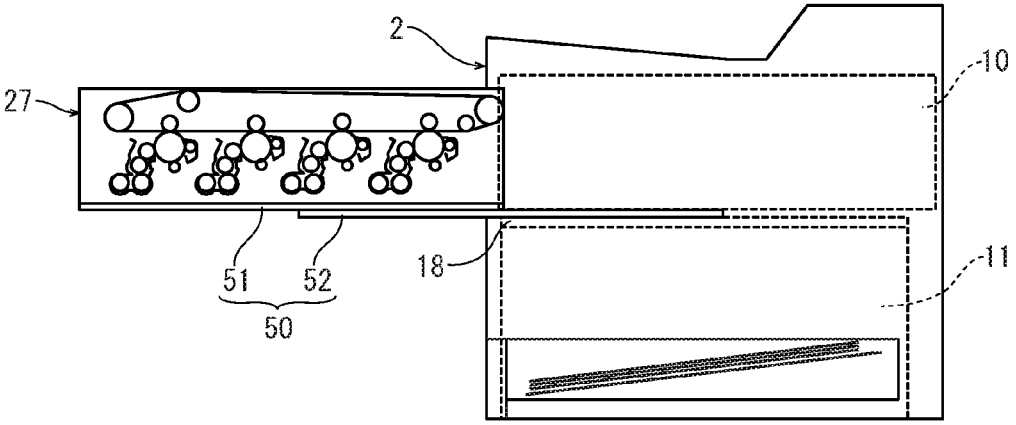
FIG. 15C is a side view showing the image forming unit at a second drawing step, in the color printer according to one embodiment of the present disclosure.
Figure 16:
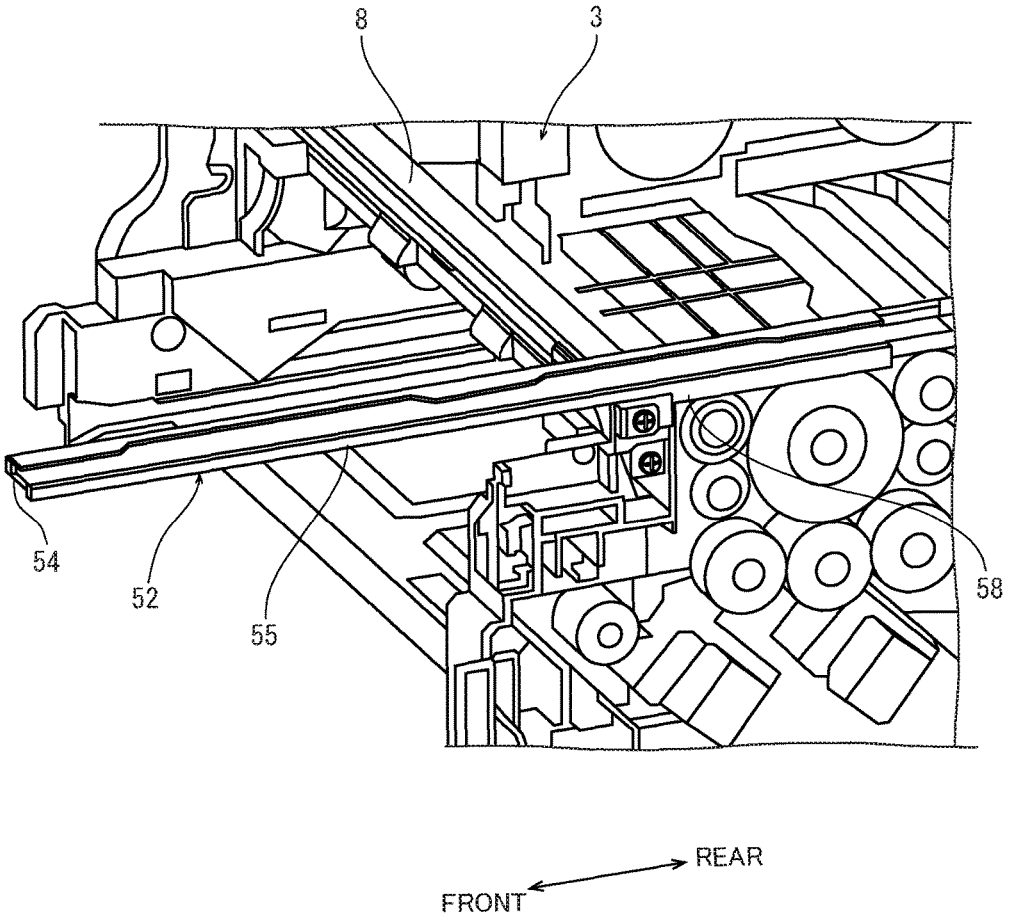
FIG. 16 is a perspective view showing the image forming unit drawn into the second drawing step, in the color printer according to one embodiment of the present disclosure.

A drawing operation of the image forming unit 27 having the above-mentioned configuration from the unit storage space 10 will be described with reference to FIGS. 15A, 15B, 15C and 16. FIG. 15A shows the image forming unit in the storage state, FIG. 15B shows the image forming unit drawn into the first drawing step, and FIG. 15C shows the image forming unit drawn into the second drawing step. FIG. 16 is a perspective view showing the image forming unit drawn into the second drawing step.

In the storage state as shown in FIG. 15A, when the image forming unit 27 is drawn forward from the unit storage space 10, as mentioned above, the rail piece 51 is drawn forward along the movable rail 52. In this case, since the engagement piece 55 of the movable rail 52 is held in the gap 17 between each of the left and right side plates 3*c* and 3*d* of the housing 3 and each of the left and right cassette guides 15, the movable rail 52 does not slide with respect to the guide rail part 18. However, at the drawing of the image forming unit 27, the movable rails 52 may slide with respect to the guide rail parts 18. When the image forming unit 27 is drawn into the first drawing step in which the step part 51*c* of the rail piece 51 comes into contact with the stoppage piece 56 of the movable rail 52, the drawing of the image forming unit 27 is restricted once. At this first drawing step, as shown in FIG. 15B, nearly a front half of the image forming unit 27 is drawn from the unit storage space 10.

When the image forming unit 27 is further drawn forward, the movable rail 52 engaged with the step part 51*c* of the rail piece 51 is guided by the guide rail part 18 and is drawn forward together with the image forming unit 27 in the horizontal direction. In more detail, the engagement part 54 of the movable rail 52 slides along the top face 15*a* of the cassette guide 15, and the engagement piece 55 slides through the gap 17 between each of the left and right side plates 3*c* and 3*d* of the housing 3 and each cassette guide 15.

When then the image forming unit 27 is drawn into the second drawing step in which the locking piece 58 of the movable rail 52 comes into contact with the stay 8 as shown in FIG. 16, the drawing of the image forming unit 27 is restricted. At this second drawing step, as shown in FIG. 15C, nearly an entire of the image forming unit 27 is drawn out from the unit storage space 10.

As described above, in the color printer 1 according to the present disclosure, the unit-side rail 50 provided in the image forming unit 27 is slid along the guide rail parts 18 formed between the left and right side plates 3*c* and 3*d* of the housing 3 and the cassette guides 15. That is, by employing the housing 3 and the cassette guides 15 which have been conventionally provided to the apparatus main body 2, the guide rail parts 18 are formed without employing using a new member. Accordingly, it is not necessary to provide a guide rail as a dedicated member to the apparatus main body 2. This makes it is possible to reduce the size of the apparatus main body 2, reduce the number of members and remove a working process of providing the guide rail to the apparatus main body 2. Therefore, it is possible to make the image forming apparatus 1 small and reduce the cost of the image forming apparatus 1. In addition, it is also possible to restrict the drawing of the unit-side rails 50 by employing the stay 8 which has been conventionally provided.

Furthermore, the unit-side rail 50 is formed by the rail piece 51 which is formed by bending the lower end portion of each of the left and right supporting plates 30 of the image forming unit 27 and the movable rail 52 which engages with the rail piece 51, so that it is possible to draw the image forming unit 27 through the two steps of the first drawing step and the second drawing step. Accordingly, a drawing stroke of the image forming unit 27 can be made long and therefore the image forming unit 27 can be drawn stably. Further, since the rail pieces 51 are integrally formed with the left and right supporting plates 30 of the imaging unit 27, it is not necessary to provide a rail as a dedicated member to the image forming unit 27. Accordingly, it is possible to further reduce the number of members and the number of working processes.

Furthermore, in a case in which the movable rails 52 are made of a metal material, since the cassette guides 15 are made of a resin material, it is possible to enhance a sliding property of the movable rails 52 with respect to the guide rail parts 18. Still further, since the movable rails 52 slide on top faces of a plurality of protruded parts 16 formed on the top faces 15*a* of the cassette guides 15, it is possible to reduce a contact area of the movable rails 52 and the top faces 15*a* of the cassette guides. Accordingly, the movable rails 52 can be drawn smoothly.

The embodiment was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a housing provided with a cassette storage space configured to store a sheet feeing cassette and a unit storage space disposed above the cassette storage space and configured to slidably support an image forming unit, the housing having a pair of side plates arranged to be opposite to each other in a direction intersecting a sliding direction of the image forming unit, and a pair of cassette guides provided in the cassette storage space and arranged inside the pair of side plate, wherein a guide rail part is formed by a gap between each of the pair of side plates and each of the pair of guide cassettes arranged inside the pair of side plates, and a top face of each of the pair of cassette guides and a unit-side rail provided to the image forming unit is slidably engaged with the guide rail part.

2. The image forming apparatus according to claim 1, wherein the unit-side rail includes a rail piece formed on a lower face of the image forming unit and a movable rail configured to slidably engage with the rail piece and slidably engage with the guide rail part, and the image forming unit is drawn from the unit storage space through two steps of a first step in which the rail piece slides with respect to the movable rail and a second step in which the movable rail slides with respect to the guide rail part.

3. The image forming apparatus according to claim 1, wherein the cassette guide is made of a resin and a plurality of protruded parts are formed on the top face.

4. The image forming apparatus according to claim 2, wherein the image forming unit includes a pair of supporting plates arranged to be opposite to each other in a direction intersecting the sliding direction of the image forming unit, the rail pieces are formed by bending lower end portions of the pair of supporting plates in an inward direction opposing to each other, and the movable rail includes an engagement part of a U-shaped sectional shape configured to engage with the rail piece and supported on the top face of the cassette guide and an engagement piece of a plate shape configured to be inserted in the gap between the side plate and the cassette guide.

5. The image forming apparatus according to claim 4, wherein a plurality of semispherical projections are formed on a lower face of the rail piece at a predetermined interval.

6. The image forming apparatus according to claim 1, wherein the gap is formed between an upper end portion of the cassette guide and the side plate.

7. The image forming apparatus according to claim 1, wherein each of the pair of side plates includes a holding piece protruding inward configured to prevent the unit-side rail from floating from the guide rail part.

8. The image forming apparatus according to claim 1, wherein the housing includes a stay bridged between the pair of side plate on a boundary of the cassette storage space and the unit storage space, the unit-side rail includes a locking piece protruding downward at a predetermined position along the sliding direction, and when the image forming unit is drawn from the unit storage space, the locking piece of the unit-side rail is engaged with the stay to prevent the drawing of the unit-side rail along the guide rail part.

* * * * *